United States Patent [19]

Van Oostrum

[11] 4,188,562

[45] Feb. 12, 1980

[54] COLOR DISPLAY TUBE AND METHOD OF MANUFACTURING SUCH A COLOR DISPLAY TUBE

[75] Inventor: Karel J. Van Oostrum, Eindhoven, Netherlands

[73] Assignee: U.S. Philips Corporation, New York, N.Y.

[21] Appl. No.: 946,670

[22] Filed: Sep. 28, 1978

[30] Foreign Application Priority Data

Oct. 27, 1977 [NL] Netherlands ..... 7711772

[51] Int. Cl.[2] ..... H01J 29/07; H01J 31/20; H01J 9/14

[52] U.S. Cl. ..... 313/402; 29/25.17; 313/403

[58] Field of Search ..... 313/402, 403, 408, 848, 313/350, 355, 357; 29/25.17

[56] References Cited

U.S. PATENT DOCUMENTS

| | | | |
|---|---|---|---|
| 3,398,309 | 8/1968 | Kaplan | 313/402 X |
| 3,502,942 | 3/1970 | Khan et al | 313/408 X |
| 4,001,620 | 1/1977 | Endriz | 313/403 X |
| 4,059,781 | 11/1977 | Van Alphen et al | 313/403 |

*Primary Examiner*—Palmer C. Demeo
*Attorney, Agent, or Firm*—Algy Tamoshunas

[57] ABSTRACT

A color display tube having a quadrupole post-focusing color selection electrode comprising a metal plate having a very large number of apertures, one side of the plate being covered with an insulating film on which a metal film is provided. The insulating film and metal film extend on two opposite portions of the wall of each aperture so that the plate and metal film form a pair of electrodes for producing an electron lens in the apertures.

4 Claims, 11 Drawing Figures

COLOR DISPLAY TUBE AND METHOD OF MANUFACTURING SUCH A COLOR DISPLAY TUBE

The invention relates to a colour display tube comprising in an evacuated envelope means to generate a number of electron beams, a display screen comprising a large number of regions luminescing in different colours, and colour selection means comprising a metal plate having a large number of apertures which assign each electron beam to luminescent regions of one colour, in which apertures an electron lens is formed.

The invention also relates to a method of manufacturing such a colour display tube.

Such a colour display tube of the post-focusing type is disclosed in Netherlands Patent Application 7,409,642 corresponding to U.S. Pat. No. 4,059,781.

The object of post-focusing is to increase the brightness of the displayed picture by increasing the transmission of the colour selection means. In tubes without post-focusing a very large part, for example 80 to 85%, of the electrons is intercepted by the so-called shadow mask. By the use of post-focusing, the apertures in the colour selection means can be enlarged since, as a result of the focusing in the apertures, the electron spots on the screen are considerably smaller than the apertures so that nevertheless sufficient landing tolerance exists. In the above cited patent, electrostatic lenses are formed in the apertures of the shadow mask, which lenses focus the electron beams in one direction and defocus them in the direction normal thereto.

An embodiment described in the patent has colour selection means consisting of an apertured metal plate with and conductive strips between rows of the apertures. The strips are interconnected and are secured to the metal plate while being insulated therefrom. This known embodiment is characterized in that it consists of three layers placed one against the other, namely two conductive layers with an insulating layer inbetween. With a potential difference between the set of conductive strips and the metal plate, an electrostatic lens is formed which converges in one direction and diverges in the direction normal thereto.

In this known embodiment with conductive strips having a thickness of 1 μm and a thickness of the insulating material of 50 μm, the focusing voltage between the conductive strips and the plate must therefore be approximately 2.6 kV with the colour selection means situated at approximately 2 mm from the display screen and provided with square apertures having a pitch of 750 μm and a width of 500 μm.

It is the object of the invention to provide a colour display tube of the post-focusing type in which the lens action in the apertures of the colour selection means is as strong as in the arrangement described in the patent but is achieved with a considerably lower focusing voltage.

According to the invention, a colour display tube of the kind mentioned in the preamble is characterized in that the metal plate is covered on one side with an insulating film on which a metal film is provided. The insulating film and metal film, in addition, extend on two oppositely located parts of the wall of each aperture. As a result of this, a quadrupole lens is formed in each aperture because in this embodiment the electrodes generating the quadrupole field are situated on the walls of each aperture and located in one plane. The lens strength, moreover, becomes larger as the thickness of the plate is increased.

The advantage of this arrangment is that the focusing voltage may be lower and will be approximately 600 V with colour selection means according to the invention at a distance of likewise approximately 9 mm from the display screen and with square apertures having a width of 500 μm and a mutual pitch of 750 μm.

The insulating film may be a lacquer, a glass or a suitable synthetic resin. The metal film on one side of the plate and on two oppositely located parts of the wall of each aperture may be obtained by vapour-deposition of a metal, by spraying a metal paint or by means of photo-etching methods. The uncoated insulation material is then dissolved or etched away.

Preferably, however, the metal plate consists of aluminum on which an insulating aluminum oxide film is obtained by anodizing. In addition, to minimize differences in expansion, an aluminum film is preferably vapour-deposited on the aluminum oxide layer.

A preferred method of manufacturing such a colour display tube of the post-focusing type is as follows. The colour selection means is formed by providing apertures of the desired shape in an aluminum plate. Thereafter, at least one side of the plate and the walls of each aperture are anodized and one anodized side of the plate is covered with an aluminum film by deposition of aluminum particles. The direction of incidence of the aluminum particles during coating is chosen to be such that two oppositely located wall parts of the apertures are also covered with an aluminum film. The uncoated part of the aluminum oxide obtained by anodizing is then etched away from the other wall parts of the apertures and possibly from the remainder of the plate. Solvents which dissolve the aluminum oxide but do not dissolve the aluminum are known (for example, from J. Electrochem, Soc. 121 (1974) (1019).

The invention will now be described in greater detail with reference to a drawing, which;

Figure 1:
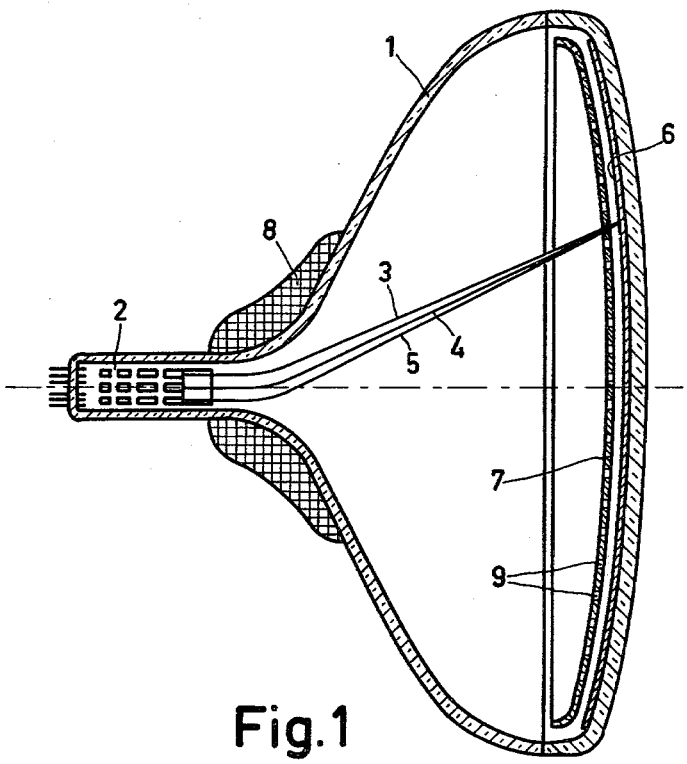
FIG. 1 is a sectional view of a colour display tube according to the invention, FIG. 2 explains in detail the principle of quadrupole post-focusing.
Figure 2:
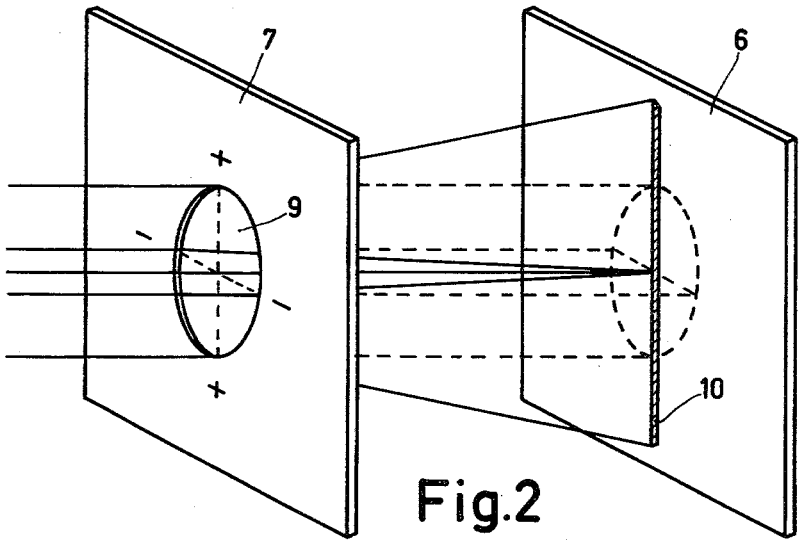

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips which luminesce in red, green and blue, and the longitudinal direction of which is normal to the plane of the drawing of FIG. 1. During normal operation of the tube, the phosphor strips are vertical and FIG. 1 thus represents a horizontal sectional view of the tube. The colour selection means 7 comprise a large number of apertures 9 which are shown diagrammatically only in FIG. 1. The three electron beams 3, 4 and 5 pass through the apertures 9 at a small angle to each other and consequently each impinges only upon phosphor strips of one colour. The apertures 9 in the colour selection means 7 are thus very accurately positioned with respect to the phosphor strips of the display screen 6. A quadrupole lens is formed in each aperture 9. FIG. 2 diagrammatically illustrates such a quadrupole lens and shows a part of the colour selection means 7 and one of the apertures 9. The potential variation along the edge of the aperture 9 is denoted by +, −, +, − in such manner that a quadrupole field is formed. In the figure, the electron beam which passes through the aperture 9, is focused in the horizontal shown plane and is defocused in the vertical plane so that, when the display screen is positioned exactly at the horizontal focus, the electron spot 10 is formed.

It is advantageous not to focus the beam exactly on the display screen 6 so that a slightly wider electron spot is obtained. The focusing has only a minor influence on the trajectory of the electron beam the beam passes through the aperture 9 at a small angle; so that the colour selection of the three electron beams 3, 4 and 5 takes place quite analogously to that in known shadow mask tube without post-focusing. However, as a result of the strong focusing, the aperture 9 can be much larger than in known shadow mask tube without post-focusing so that many more electrons impinge upon the display screen and form a considerably brighter picture. The defocusing in the vertical direction need not be a disadvantage when phosphor strips are used which are parallel to the longitudinal direction of the spot 10.

Figure 3:
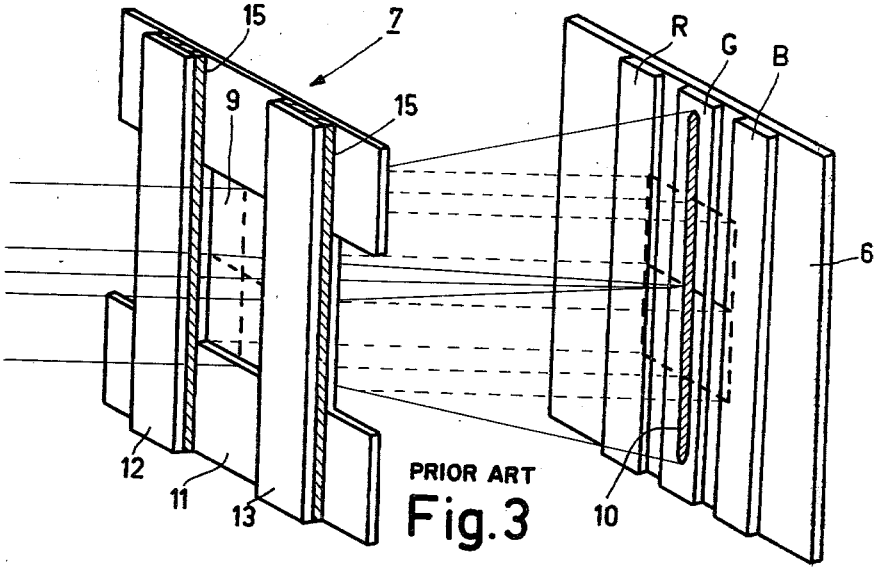
PRIOR ART Fig.3
FIG. 3 is a perspective view of a known embodiment.

FIG. 3 shows a prior art colour selection means. The colour selection means 7, in this case, consist of an iron plate 11 which has apertures 9 and a large number of conductive strips of which two are denoted by 12 and 13 between the apertures 9. The conductive strips are insulated from the iron plate by means of insulation material 15. The plate 11 has a thickness of 150 μm. The insulation material 15 is an aluminium oxide layer 50 μm thick. The conductive strips consist of vapour-deposited aluminum and are 1 μm thick. The apertures 9 are 500×500 μm and their pitch is 750 μm so that the transmission of the colour selection means is approximately 44%. At a potential of the display screen 6 of 25 kV, a potential of the plate 11 of likewise 25 kV, and a potential of the conductive strips 12 and 13 of 22.4 kV, the focal distance of the lenses is 13 mm with normal incidence in the centre of the display screen. The electron spots in the centre of the display screen are approximately 0.10 mm wide and in the corners approximately 0.09 mm wide and there is no focusing ring visible on the display screen. The width of the phosphor strips R, G and B is 0.13 mm. As a result of the insulation material 15, the focusing voltage between the plate 11 and the conductive strips 12 and 13 must be approximately 2600 V. It is the object of the invention to provide a construction in which an equally strong lens is obtained with a considerably lower voltage between the plate and the conductive strips.

Such a construction and a method of manufacturing thereof will be described with reference to the following figures.

Figure 4:
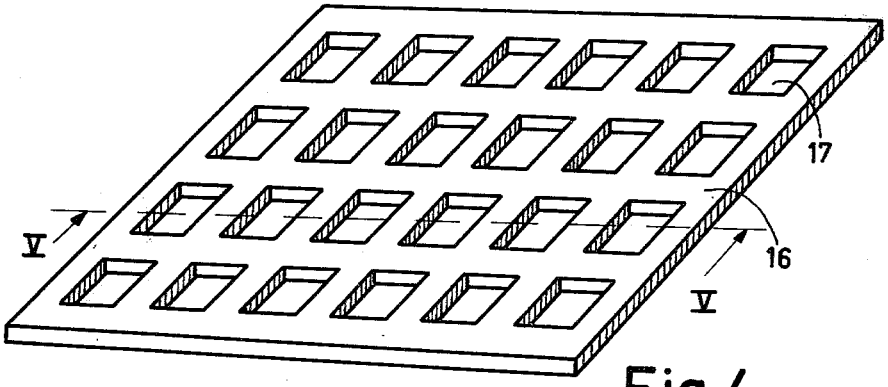
FIG. 4 is a perspective view of the starting material for making the colour selection means of the invention, FIGS. 5 to 9 explain the method of making the colour selection means in accordance with the invention.

FIG. 4 is a perspective view of a part of an aluminum plate 16 which serves as starting material for an embodiment of the colour selection means according to the invention. The plate has a large number of apertures 17 which in this case are also square and have a width of 500 μm. However, the apertures may alternatively be more or less oval or circular.

Figure 5:
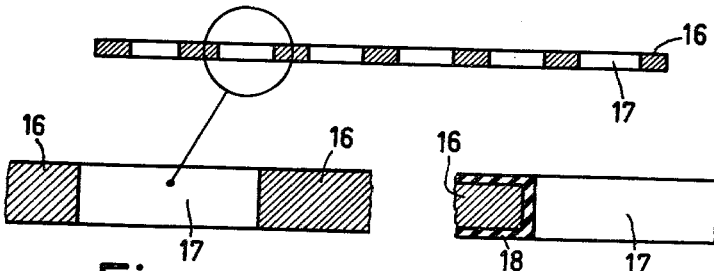

FIG. 5 is a sectional view of the aluminum plate 16 shown in FIG. 4. The thickness of the plate in this case is 300 μm.

Figure 6:
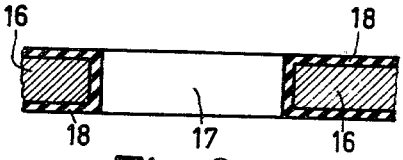

FIG. 6 shows how the plate 16 has been provided with an aluminum oxide skin 18 by anodizing. The thickness of the aluminum oxide skin in this case is 50 μm.

Figure 7:
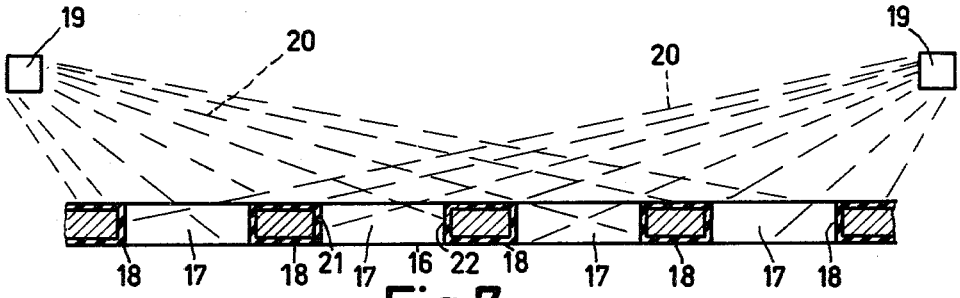

FIG. 7 shows how the vapour deposition of a metal film, in this case an aluminum film, takes place from the sources 19. The vapour deposition sources are arranged so that the aluminum particles 20 impinge upon the plate 16 at an angle and thus also cover two oppositely located parts 21 and 22 of the wall of the apertures 17 with an aluminum film. Instead of the vapour deposition sources, nebulizers with which a metal paint is sprayed may alternatively be used. It is alternatively possible to cover two opposite located parts of the wall of each aperture with a conductive film by means of a photo-etching method and exposure by means of two light sources.

Figure 8:
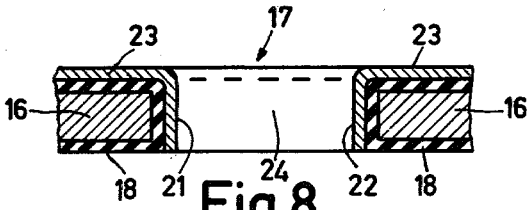
Figure 9:
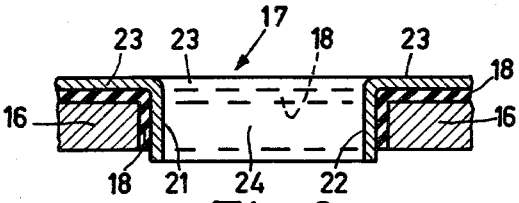

FIG. 8 shows diagrammatically the result of the provision of the metal film. The plate 16 is covered with an aluminum oxide layer 18. An aluminum film 23 is provided on the layer 18 covering one side of the plate 16 and on the aluminum oxide layer 18 which, moreover, extends on two oppositely located sides of the apertures 17. The thickness of the aluminum film in this case is 1 μm. The parts 24 and 25 not covered with an aluminum film (part 25 is not visible) on the wall of the aperture are still coated with aluminum oxide. The colour selection means according to the invention is obtained after the removal of the aluminum oxide which, as is known, may be carried out in a solution of 5% $H_3PO_4$ and 2% $CrO_3$ in water at 85° C. After the removal, four electrodes are present on the walls of each aperture 17 formed by a set of two electrodes consisting of aluminum film on the vertical parts 21 and 22 of the wall of each aperture and a second set of two electrodes consisting of uncovered wall parts 24 and 25, as shown in FIG. 9.

Figure 10:
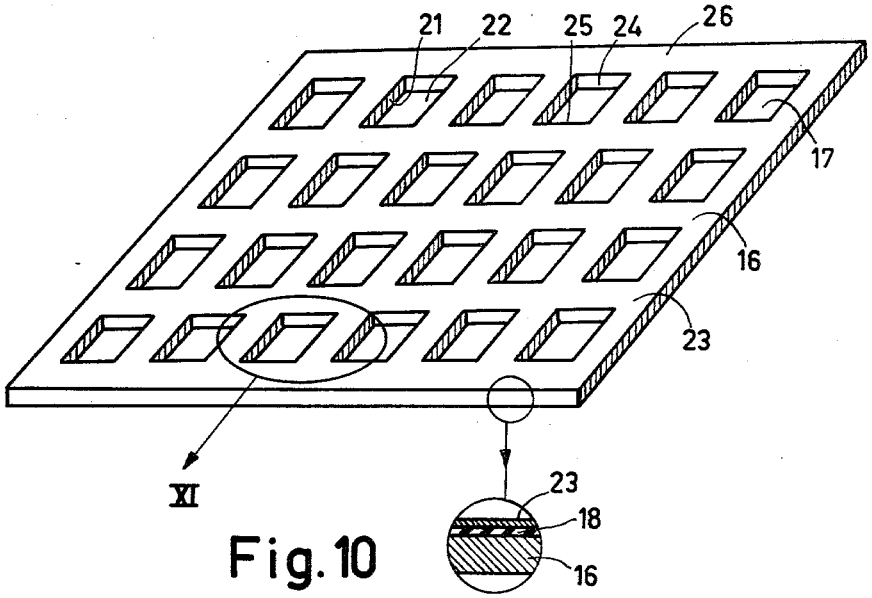
FIG. 10 shows the colour selection means for a colour display tube of the post-focusing type according to the invention, and FIG. 11 explains the operation of the colour selection means.
Figure 11:
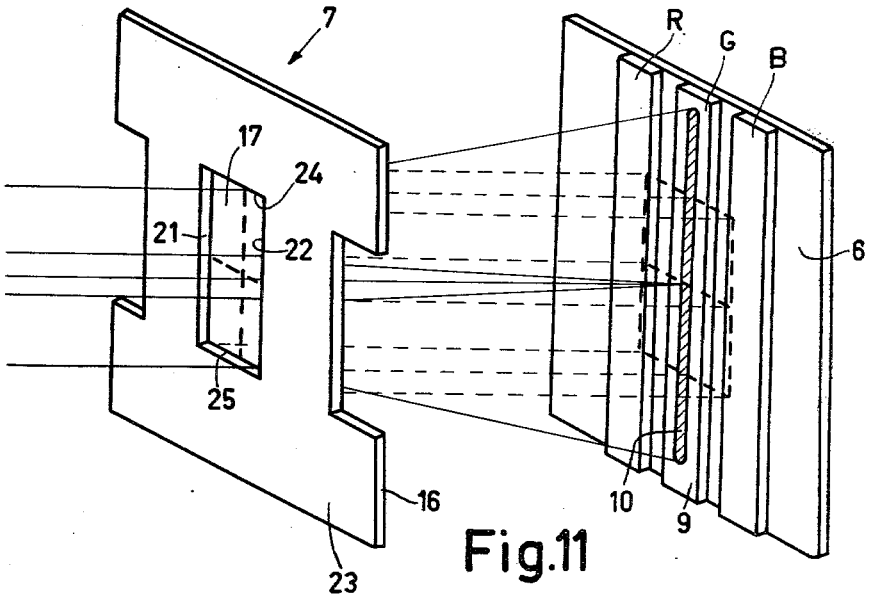

FIG. 10 is a perspective view of a part of the colour selection means according to the invention. The plate 16 having apertures 17 is coated with an aluminum oxide layer 18 and a metal film 23 on the side 26 and on parts 21 and 22 of the wall of each aperture. The parts 24 and 25 of the wall of each aperture are formed by the metal of plate 16. With colour selection means shown in FIG. 10 mounted in a display tube 9 mm from the display screen and having square apertures with a width of 500 μm and a mutual pitch of 750 μm in a manner such that the electron transmission is approximately 44%, the following results are achieved which are explained with reference to FIG. 11. At a potential of 25 kV of the display screen 6, which is covered with the usual aluminum film, a potential of 24.4 kV on the film 23 and a potential on the plate 16 of 25 kV, the focal distance of the quadrupole lenses is approximately 13 mm in the centre of the display screen. The distance from the colour selection means 7 to the display screen 6 is approximately 9 mm so that the focus of the quadrupole lenses lies everywhere just slightly beyond the display screen. This prevents the so-called focusing ring is visible on the display screen. The electron spots are then approximately 0.10 mm wide in the centre of the display screen and approximately 0.09 mm wide in the corners. A suitable width of the phosphor strips R, G and B is then 0.13 mm. The remainder of the surface of the display screen 6 may or may not be coated with light-absorbing material.

A display screen for a tube according to the invention can be manufactured by means of a known exposure method in which the colour selection means is displayed on a photosensitive layer on a window portion of the tube. In connection with the large transmission of the colour selection means according to the invention, the exposure method used should be suitable to reproduce the apertures 9 in a considerably narrowed manner. An exposure method suitable for this purpose uses two or more light sources at some distance from each other as described in German Patent Application 2,248,878. Of course, a tube according to the invention is also suitable for so-called electronic exposure, in which the sensitive layer on the window portion is "exposed" by means of an electron beam.

What is claimed is:

1. A colour display tube comprising in an evacuated envelope means for generating a plurality of electron beams, a display screen comprising a large number of regions luminescing in different colours, and colour selection means comprising a metal plate having a large number of apertures therein which assign each electron beam to luminescent regions of one colour, an insulating film covering one side of said metal plate and a metal film provided on said insulating film, said insulating film and metal film extending on two opposite portions of the wall of each aperture, said plate and said metal film defining a pair of electrodes for producing an electron lens in said apertures.

2. A colour display tube as claimed in claim 1, wherein the metal plate is an aluminum plate and the insulating film is aluminum oxide.

3. A colour display tube as claimed in claim 2, wherein the metal film is aluminum.

4. A method of making a colour selection means for a colour display tube comprising the steps of providing a plurality of apertures in an aluminum plate, anodizing at least one side of said plate and the walls of each aperture to form a layer of aluminum oxide thereon, covering the anodized side of the plate with an aluminum film by depositing aluminum particles thereon, the direction of incidence of the aluminum particles during deposition being such that two opposite wall portions of the apertures are also covered with said aluminum film, and etching away the aluminum oxide from the wall portions of the apertures that are not covered by said aluminum film.

* * * * *